United States Patent [19]

Mandelli

[11] 4,270,325

[45] Jun. 2, 1981

[54] DEVICE FOR INSTALLING TILES

[76] Inventor: Luigi Mandelli, Via Ponti, Monteveglio, Province of Bologna, Italy

[21] Appl. No.: 21,537

[22] Filed: Mar. 19, 1979

[30] Foreign Application Priority Data

Mar. 21, 1978 [IT] Italy ..... 3367 A/78

[51] Int. Cl.[3] ..... E04F 13/08

[52] U.S. Cl. ..... 52/391

[58] Field of Search ..... 52/391, 386, 387

[56] References Cited

U.S. PATENT DOCUMENTS

| | | | |
|---|---|---|---|
| 705,156 | 7/1902 | Stevens | 52/391 |
| 2,073,130 | 3/1937 | Wallace | 52/386 X |
| 2,346,769 | 4/1944 | Lichtor | 52/391 X |
| 3,701,228 | 10/1972 | Taylor | 52/386 |
| 3,731,445 | 5/1973 | Hoffmann et al. | 52/391 |
| 4,143,496 | 3/1979 | Destito | 52/391 X |

FOREIGN PATENT DOCUMENTS

| | | | |
|---|---|---|---|
| 577232 | 6/1959 | Canada | 52/391 |
| 2145523 | 3/1973 | Fed. Rep. of Germany | 52/391 |
| 983747 | 2/1951 | France | 52/391 |

*Primary Examiner*—J. Karl Bell

*Attorney, Agent, or Firm*—Guido Modiano; Albert Josif

[57] ABSTRACT

A device for installing tiles on surfaces to be lined comprises a support, whereto a tile is to be attached by an adhesive, and provided with rabbet coupling elements effective to provide a rabbet coupling with the surface to be lined on which counter rabbet coupling means are anchored.

3 Claims, 6 Drawing Figures

Fig. 1
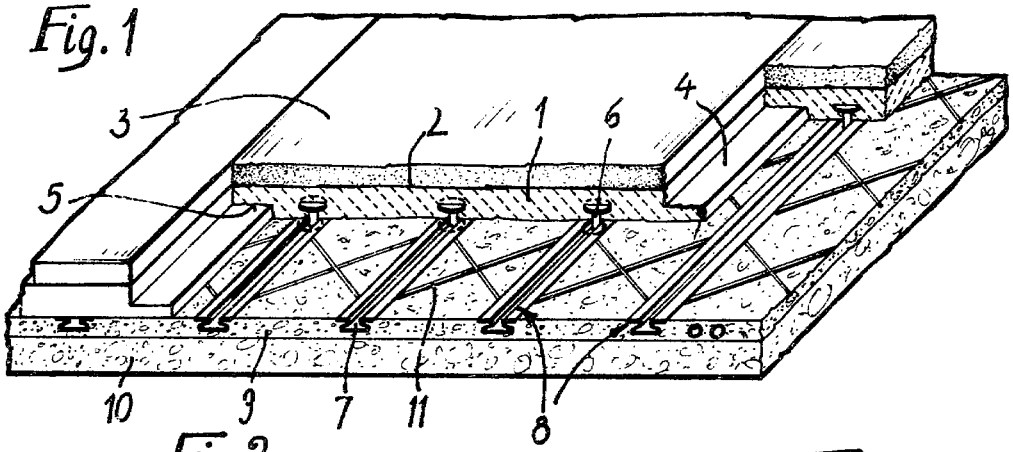
Fig. 2
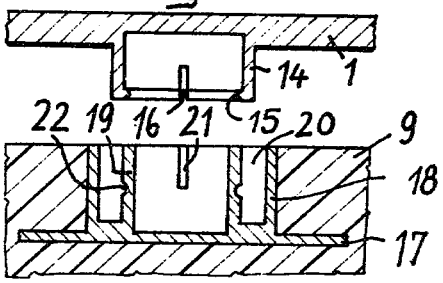
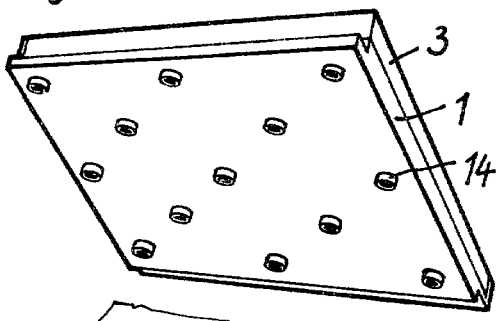
Fig. 3
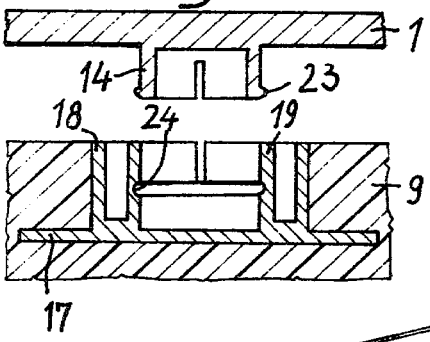
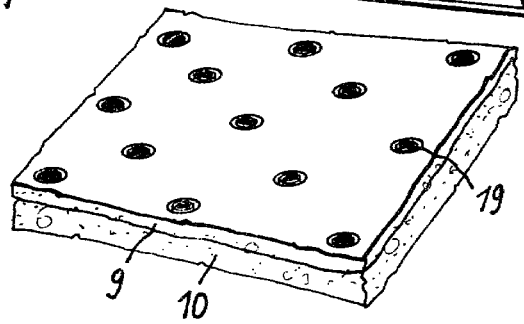
Fig. 4
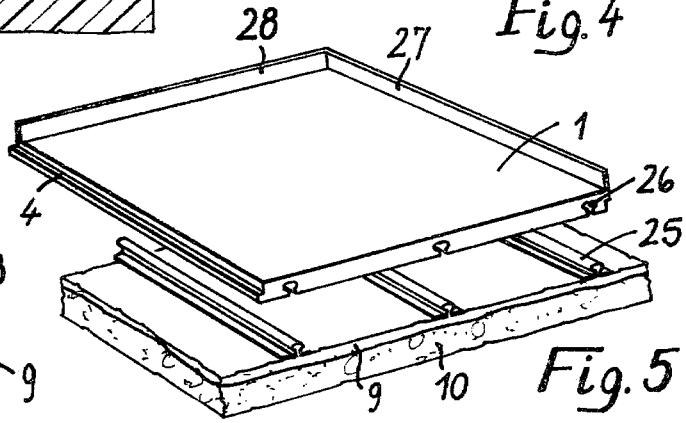
Fig. 5
Fig. 6
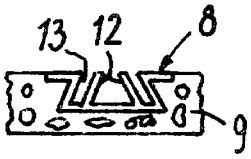

DEVICE FOR INSTALLING TILES

BACKGROUND OF THE INVENTION

This invention relates to a device for installing tiles on surfaces to be lined, such as walls and floors.

As is known tiles are currently installed by means of a binder (adhesive, cementitious mortar) interposed between the bottom surface of the tiles and the surface to be lined or coated.

The surface is composed of a layer of cementitious mortar which serves as the substrate and is suitably smoothed and in which are embedded the pipes for the utilities such as heating, water and electricity.

The traditional technique of tile installation has some serious drawbacks. First of all, it is time consuming and requires specialized labor. Moreover, if it becomes necessary to service underlying pipes for making connections or repairs, part of the lining must be pulled down, which most of the times involves replacement of all of the tiles because the ones pulled down, years after their installation, are no longer available.

SUMMARY OF THE INVENTION

This invention sets out to provide a device which facilitates and speeds up the installation of the tiles and, when necessary, permits their removal.

This object is achieved by a device which is characterized in that it comprises a support whereto a tile is to be attached with the interposition of adhesives and which is provided with means for a rabbet coupling to means anchored to the surface to be lined.

BRIEF DESCRIPTION OF THE DRAWING

Further features will be more clearly apparent from the following description in conjunction with the accompanying drawing, where:

FIG. 1 is a perspective, partly sectional, view of a floor wherein the tiles have been applied with a device according to the invention;

FIGS. 2 and 3 are sectional views of the rabbet coupling means;

FIG. 4 is a perspective view of a tile and the surface to be lined, provided with the coupling means of FIG. 2;

FIG. 5 is a perspective view of a further embodiment of the invention; and

FIG. 6 shows a detail of the coupling means anchored to the surface to be lined.

DESCRIPTION OF THE PREFERRED EMBODIMENT

The device for tile installation comprises a rigid support 1 whereto, with the interposition of a layer 2 of a suitable adhesive, is to be attached an ordinary tile 3 of ceramics or other material. The support 1 is formed from resins or inert materials and has, at two opposite parallel sides, a projection 4 and recess 5 which lie in the plane of the support 1. From the lower or bottom face of the support 1 there project coupling means in the form of mushrooms 6, uniformly spaced along parallel rows. The mushrooms 6 are adapted for rabbet engagement in the grooves 7, either of dovetail or inverted "T" configuration, of sectional anchoring members 8 embedded in a mortar layer 9 covering the floor 10. Spacers 11 are effective to hold the sectional members 8 spaced apart and perfectly parallel to one another.

To facilitate the insertion of the mushrooms 6 into the grooves 7, the sectional members 8 are made of a material possessing a certain elasticity at least at the mouth of their groove. Suitably, to prevent the layer 9 from neutralizing this ability to flex, the sectional members 8 have a cross-section as indicated in FIG. 6, where the groove 7 is formed by two wings 12 which define on the outsides two interspaces 13 which prevent the mortar of the layer 9 from adhering to the wings 12 to allow the latter to flex during the introduction of the mushrooms 6.

The tiles are installed by aligning them and forcing the mushrooms 6 into the grooves 7. It should be noted that to take up the play, or clearance, between adjacent tiles, provision is made for the use of a material adapted for sealing the joints between the adjacent edges of the tiles and between the projections 4 and recesses 5 of the supports.

The coupling means of the support to the floor or wall may differ from the ones described above.

In the embodiment of FIG. 2, provision is made for tubular projections 14 to protrude downwards which are provided, at the free end, with an inner annular embossment 15 and axial notches 16. The tubular projections 14 are intended for coupling to cup-like anchoring elements embedded in the mortar layer 9 which covers the floor. Each element comprises a flange 17 wherefrom there project two rings 18,19, concentrical to each other and separated by an annular interspace 20. The inner ring 19 has axial notches 21 and an outer groove 22. In a suitable manner, the projections 14 and cup elements are distributed all over the surface of the support and floor, as shown in FIG. 9.

The coupling of the support to the wall is effected by introducing the projections 14 into the annular interspaces 20 such that the annular embossments 15, by engaging with the grooves 22, produce a catch which prevents the projections 14 from sliding out. The variation of FIG. 3 differs from that of FIG. 2 in that the tubular projection 14 is provided with an outer collar 23 and that the inner ring 19 is provided with an inner groove 24. In this embodiment, the projection 14 penetrates the ring 19 until the projection 23 engages in the groove 24. The interspace 20 has the function of preserving the elasticity of the inner ring 19 to prevent the latter from being blocked by the mortar of the layer 9.

Finally, in the embodiment of FIG. 5, the coupling of the tile to the floor is obtained by providing on the latter sectional members 25 of mushroom cross-sectional shape adapted for rabbet insertion in complementary grooves 26, formed in the lower face of the support 1. It should be noted that from the edges which form one corner of the support there rise two side pieces 27,28 having the same height as the tiles which form a square adapted for facilitating the positioning of the tiles and creating a thickness between the tiles which has the function of taking up plays and of sealing the joints.

The device according to the invention, thanks to the elastic retention between the coupling means, permits at any time removal of the tiles for servicing the underlying pipes 29 embedded in the layer 9.

The application of the tiles 3 to the supports 1 can be carried out at the factory. The adhesive layer 2 may have a thickness such as to ensure that the combined thickness of the tile and support is strictly constant. Thus, it is possible to make a correction that cancels the thickness deviations of the tiles.

The device, in addition to permitting the tiles to be installed flat, also allows the application of wall linings. The sealant which is interposed between the adjacent edges of the tiles and between the projections 4 and recesses 5 will have a limited adhesive power dependent on the individual requirements.

I claim:

1. A device for installing tiles on a surface to be lined, comprising a support having a front side on which a tile is attached with the interposition of adhesives and a rear side provided with coupling means, anchoring means mounted on the surface to be lined and co-operating with said coupling means for detachably holding said support with the tile attached thereon, wherein according to the improvement said coupling means comprises tubular projections in spaced apart relation and said anchoring means comprises cup-like elements embedded in the surface to be lined and having a flange wherefrom a pair of concentrical rings project, said rings defining an annular interspace.

2. A device as defined by claim 1 in which said tubular projection engages said annular interspace and has an inner collar engaging a corresponding annular groove provided on the outer surface of the inner ring.

3. A device as defined by claim 1 in which said tubular projection engages said inner ring and has an outer collar engaging a corresponding annular groove provided on the inner side of the inner ring.

* * * * *